US007727080B1

(12) United States Patent
Fitzgerald

(10) Patent No.: US 7,727,080 B1
(45) Date of Patent: Jun. 1, 2010

(54) GOLF DRIVER IMPACT ANALYZER

(76) Inventor: Lisa M. Fitzgerald, 8337 Silo Ct., Sarasota, FL (US) 34240

( * ) Notice: Subject to any disclaimer, the term of this patent is extended or adjusted under 35 U.S.C. 154(b) by 0 days.

(21) Appl. No.: 12/360,598

(22) Filed: Jan. 27, 2009

(51) Int. Cl.
*A63B 69/36* (2006.01)

(52) U.S. Cl. ..... 473/221; 473/223

(58) Field of Classification Search ..... 473/219–224, 473/226, 228, 229, 234, 257, 266, 269
See application file for complete search history.

(56) References Cited

U.S. PATENT DOCUMENTS

| | | | |
|---|---|---|---|
| 1,712,609 | A | 5/1929 | Gibson |
| 2,652,251 | A | 9/1953 | Molinar |
| 3,033,574 | A | 5/1962 | Partridge |
| 3,198,525 | A | 8/1965 | Smith |
| 3,262,705 | A | 7/1966 | Nunziato |
| 3,298,693 | A | 1/1967 | Eisenberg |
| 3,719,363 | A | 3/1973 | Harrison |
| 3,758,117 | A | 9/1973 | Harrison |
| 4,576,378 | A | 3/1986 | Backus |
| 4,789,158 | A | 12/1988 | Chiesa |
| 4,789,160 | A | 12/1988 | Dollar, Jr. et al. |
| 4,949,971 | A | 8/1990 | Thornton |
| 5,071,129 | A | 12/1991 | Wilson |
| 5,082,283 | A | 1/1992 | Conley et al. |
| 5,108,103 | A | 4/1992 | Rilling |
| 5,143,376 | A | 9/1992 | Johnson |
| 5,184,826 | A | 2/1993 | Hall, Jr. |
| 5,233,544 | A | 8/1993 | Kobayashi |
| 5,277,428 | A | 1/1994 | Goodwin et al. |
| D347,457 | S | 5/1994 | Armstrong, III |
| 5,310,188 | A | 5/1994 | Hernberg |
| 5,351,962 | A | 10/1994 | Lin |
| 5,415,406 | A | 5/1995 | Reichenbach et al. |
| 5,527,039 | A | 6/1996 | Levesque |
| 5,605,509 | A | 2/1997 | Gray |
| 5,620,376 | A | 4/1997 | Hsu |
| 5,716,286 | A | 2/1998 | Swan |
| 5,762,564 | A | 6/1998 | Schang |

(Continued)

OTHER PUBLICATIONS

Freddy Connect Products, Inc., Dual Trace Swing Trainer, www.dwquailgolf.com/training/freddyconnect.html.

*Primary Examiner*—Nini Legesse
(74) *Attorney, Agent, or Firm*—Charles J. Prescott

(57) ABSTRACT

A golf swing analyzer providing a learning tool for golfers to help improve golf backswing and club face angle consistency. To gage the club angle relative to swing path, a fence is placed and held on the shaft perpendicular to the club face. During a golf swing, an air flow along this fence is created by the swinging motion of the club. For a perfect square shot, the pressures are equal on both sides of the fence; otherwise, as the fence angle changes relative to air flow, one side compacts the air, creating a high-pressure area while at the same time the opposite side dams the air flow and creates a low-pressure area. A differential pressure transducer detects this pressure difference on each side of the fence. When the ball is struck, a microphone in the device detects the ball impact and a microprocessor interprets the fence position relative to air flow based on the pressure transducer output. A microprocessor-driven speaker outputs a unique audio tone at the moment of ball impact which indicates whether the club face angle was open, closed or square, relative to the swing path.

2 Claims, 10 Drawing Sheets

U.S. PATENT DOCUMENTS

| | | | |
|---|---|---|---|
| 5,836,829 | A | 11/1998 | Van Cott et al. |
| 5,895,328 | A | 4/1999 | Pahio |
| 6,441,745 | B1 | 8/2002 | Gates |
| 6,607,450 | B1 | 8/2003 | Hackman |
| 6,692,370 | B2 | 2/2004 | Koncelik, Jr. |
| 6,699,138 | B1 | 3/2004 | Lin |
| 6,722,999 | B1 | 4/2004 | Yi |
| 6,739,981 | B1 | 5/2004 | Lin |
| 6,843,731 | B1 | 1/2005 | Oprandi |
| 7,021,140 | B2 | 4/2006 | Perkins |
| 7,258,622 | B1 | 8/2007 | Gaviria |
| 7,427,238 | B1 | 9/2008 | Oprandi et al. |
| 2002/0123386 | A1 | 9/2002 | Perlmutter |
| 2003/0207719 | A1 | 11/2003 | Hughes |
| 2005/0107180 | A1 | 5/2005 | Halleck et al. |

CR2025
+

GOLF DRIVER IMPACT ANALYZER

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to practice and corrective devices associated with the golf swing and the game of golf and more particularly to a golf club swinging guide which provides immediate audible indicia reflective of any misalignment between the golf swing itself and the direction the striking face of the golf club head faces at the moment of golf ball impact.

2. Description of Related Art

The world of golf has attracted a vast mountain of players, competitors and golf club equipment, not to mention the vast investment in golf courses themselves. However, the game of golf is premised upon a golf swing which is at best unnatural. Developing a correct swing for consistent power and accuracy is the ultimate challenge of every golfer.

One aspect of this golf swing perfection challenge is to cause the golf club striking face to strike the golf ball in a line of movement and with a club face striking face orientation which will propel the golf ball in a desired direction and with the desired amount of hook, slice or straight flight characteristics. One patent disclosure by Johnson in U.S. Pat. No. 5,143,376 has provided such a golf club swinging guide. This invention by Johnson provides a swinging guide somewhat permanently clampable onto the lower end of the golf shaft of the golf club and provides a vane pivotally connected to that mount. The vane is freely pivotal and responsive to movement of air so that the vane visibly aligns itself in the direction of the golf club swing.

U.S. Pat. No. 5,415,406 to Reichenbach et al. discloses a golf club swing training apparatus. A golf swing position indicator is taught by Dollar, Jr. et al. in U.S. Pat. No. 4,789,160. Gates teaches an apparatus and method for measuring the speed of movement of the head of a golf club and for plotting the path of movement of a golf club head using accelerometers in U.S. Pat. No. 6,441,745.

Methods and systems for analyzing the motion of sporting equipment are taught by Perlmutter in U.S. Patent Application Publication 2002/0123386. Van Cott et al. teach a golf swing training apparatus which provides audible indications of the orientation of the club face as it meets the ball and smoothness throughout the swing in U.S. Pat. No. 5,836,829.

U.S. Patent Application Publication 2003/0207719 to Hughes discloses a collapsible swing training device.

A broad array of additional U.S. patented devices also provide some means for visually aligning the striking face of the golf club head with the golf ball on a more static pre-swing basis as follows:

U.S. Pat. No. 4,789,150 Chiesa
U.S. Pat. No. 1,712,609 Gibson
U.S. Pat. No. 2,652,251 Molinar
U.S. Pat. No. 3,198,525 Smith U.S. Pat. No. 3,262,705 Nunziato
U.S. Pat. No. 3,298,693 Eisenberg
U.S. Pat. No. 3,719,363 Harrison
U.S. Pat. No. 4,576,378 Backus
U.S. Pat. No. 4,949,971 Thornton
U.S. Pat. No. 5,071,129 Wilson
U.S. Pat. No. 5,351,962 Lin
U.S. Pat. No. 5,605,509 Gray
U.S. Pat. No. 5,762,564 Schang
U.S. Pat. No. D347,457 Armstrong A previous U.S. Pat. No. 6,843,731 provides a substantial improvement over the Johnson '376 swinging guide in that many of the forces associated with the high velocity and arcuate movement of a golf club head are somewhat neutralized in my '731 patent over the Johnson device so that a more accurate indication of misalignment at the moment of golf ball impact is viewable. Further, a means for temporarily locking the misalignment relationship at the moment of golf ball impact is also provided.

Another previous U.S. Pat. No. 7,427,238 provides still further improvement in an electronic/mechanical golf club swing guide by substantially reducing the mass and inertia factors which must be dealt with during a typical golf swing and further which provides for electronic swing analysis and audible output at the moment of impact to indicate to the golfer whether the swing was correct.

The foregoing examples of the related art and limitations related therewith are intended to be illustrative and not exclusive. Other limitations of the related art will become apparent to those skilled in the art upon a reading of the specification and a study of the drawings.

BRIEF SUMMARY OF THE INVENTION

This invention is directed to the golf swing analyzer that provides a learning tool for golfers to help develop golf backswing consistency and club face angle. A golf ball will travel in the desired straight path if two conditions are met: the swing path must be in line with the desired ball trajectory, and the club face must be aligned at a right angle (90 degrees) to the ball trajectory. To gage the club angle relative to swing path, a fence is placed perpendicular to the club face. During a golf swing, an air flow along this fence is created by the swinging motion of the club. For a perfect square shot, the pressures are equal on both sides of the fence; otherwise, as the fence angle changes relative to air flow, one side compacts the air, creating a high-pressure area while at the same time the opposite side dams the air flow and creates a low-pressure area. A differential pressure transducer detects this pressure difference on each side of the fence. When the ball is struck, a microphone in the device detects the ball impact and a microprocessor interprets the fence position relative to air flow based on the pressure transducer output. A microprocessor-driven speaker outputs a unique audio tone at the moment of ball impact. With this audible tone it can be determined if the club face angle was open, closed or square, relative to the swing path.

The following embodiments and aspects thereof are described and illustrated in conjunction with systems, tools and methods which are meant to be exemplary and illustrative and not limiting in scope. In various embodiments one or more of the above-described problems have been reduced or eliminated while other embodiments are directed to other improvements. In addition to the exemplary aspects and embodiments described above, further aspects and embodiments will become apparent by reference to the drawings and by study of the following descriptions.

BRIEF DESCRIPTION OF THE SEVERAL VIEWS OF THE DRAWING(S)

Figure 1:
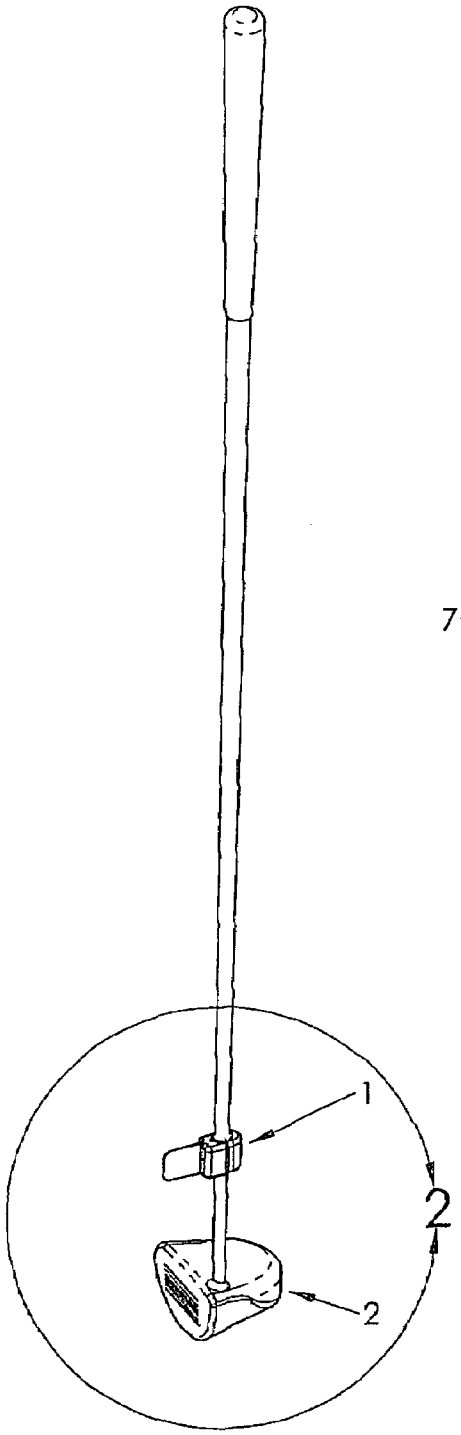
FIG. 1 is a perspective view of a golf club showing the device attached to the lower end of the shaft of that golf club.
Figure 2:
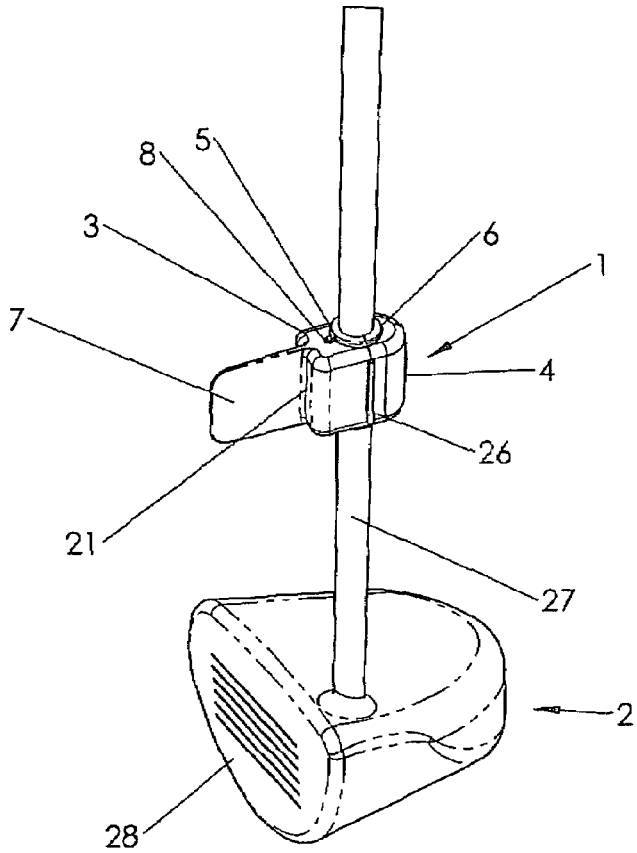
FIG. 2 is an enlarged view of area 2 of FIG. 1.
Figure 3:
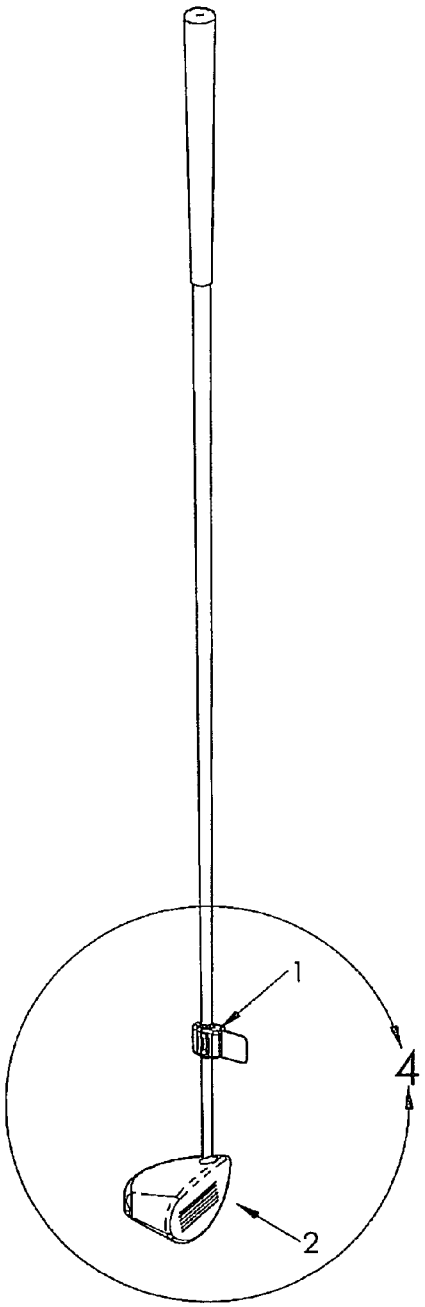
FIG. 3 is another perspective view of FIG. 1.
Figure 4:
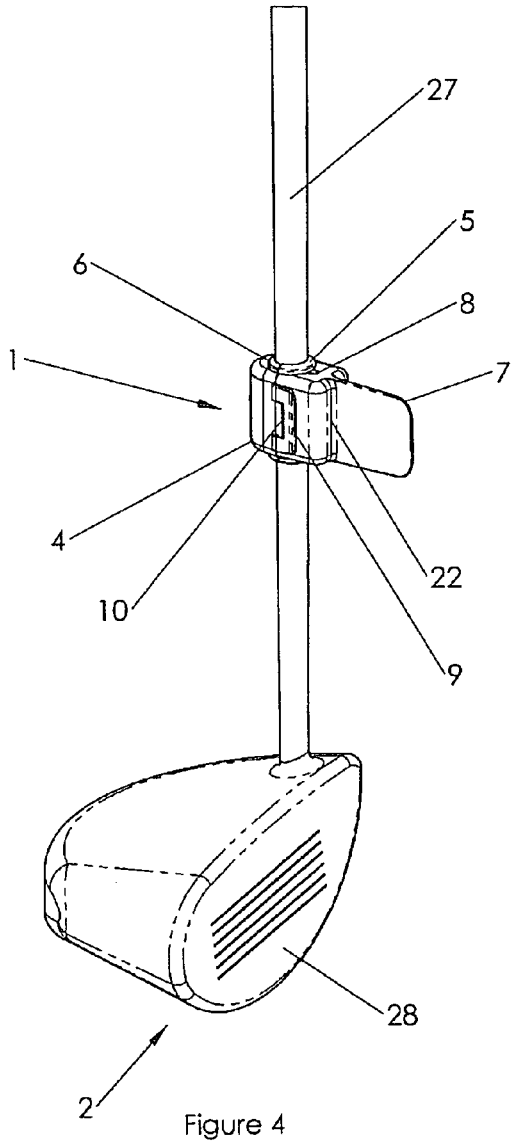
FIG. 4 is an enlarged view of area 4 of FIG. 3.

Exemplary embodiments are illustrated in reference figures of the drawings. It is intended that the embodiments and figures disclosed herein are to be considered to be illustrative rather than limiting.

DETAILED DESCRIPTION OF THE INVENTION

Definitions

1 impact analyzer
2 golf club
3 analyzer housing
4 housing retainer
5 front grip
6 rear grip
7 fence
8 speaker aperture
9 latch
10 latch retainer
11 flexible circuit board
12 tilt switch
13 battery
14 positive contact
15 negative contact
16 contact retaining screw
17 pressure transducer
18 microprocessor
19 speaker
20 anti-slip boss
21 left pressure aperture
22 right pressure aperture left pressure transducer
23 inlet right pressure transducer
24 inlet
25 microphone
26 living hinge
27 club shaft
28 club face
29 battery retainer boss
30 golf ball
31 hole
32 air flow direction
33 swing path direction
34 ball path direction
35 high pressure area
36 low pressure area
37 position arrow
38 circuit board assembly
39 rear friction pad
40 circuit retainer boss Ref. FIGS. 1, 2, 3 and 4, the golf swing analyzer 1 is attached to the lower portion of the club shaft 27 on golf club 2 by means of a molded plastic analyzer housing 3 and housing retainer 4. The housing 3 and housing retainer 4 are held together and capturing the club shaft 27 by a latch 9 engaging with a latch retainer 10 on one side, and a living hinge 26 on the opposite side.

Ref FIGS. 11, 13, 14, 15, 16 and 17, the analyzer housing 3 and housing retainer 4 are molded as a single part from polypropylene allowing the living hinge 26 to be formed in this molding. Polypropylene is a thermoplastic available from many sources. A front grip 5 and rear grip 6 are captured within the analyzer housing 3 and housing retainer 4. These grips 5 and 6 are constructed from an elastomer to provide frictional engagement and adjust to the variations of the size of the club shaft 27. This elastomer material is SANTOPRENE manufactured by ExxonMobil.

Figure 18:
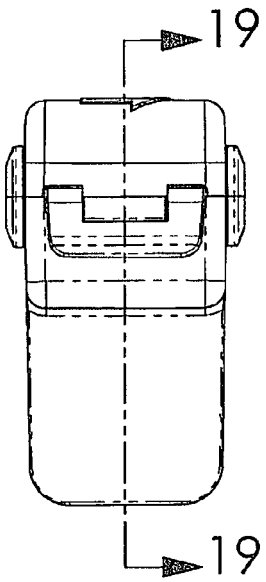
FIG. 18 is a bottom plan view of FIG. 11.
Figure 19:
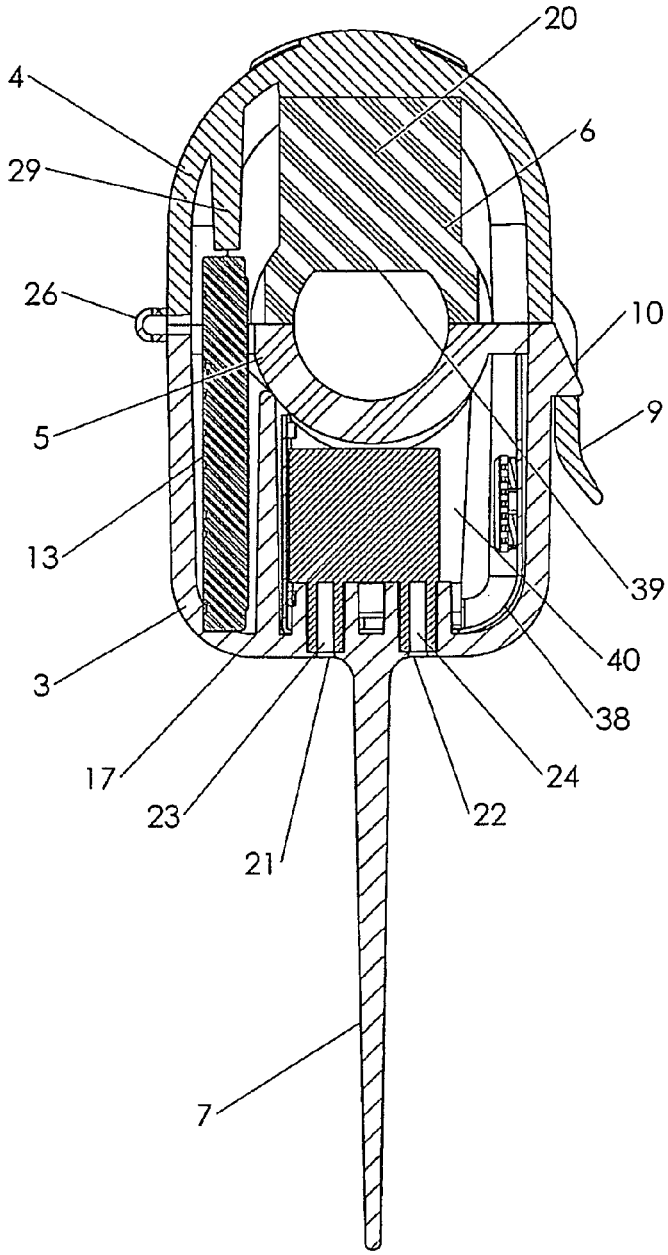
FIG. 19 is section view in the direction of arrows 19-19 of FIG. 18.

Ref. FIGS. 18 and 19, the frictional force engagement to the club shaft 27 is enhanced by a rear friction pad 39 located on the rear cylindrical inside surface of rear grip 6. This pad 39 is pressed against the club shaft 27 by an anti-slip boss 20 held in bias by the inside surface of housing retainer 4. This pressure is created by the elastic nature of the elastomer from which the friction pad 39 is constructed.

Figure 9:
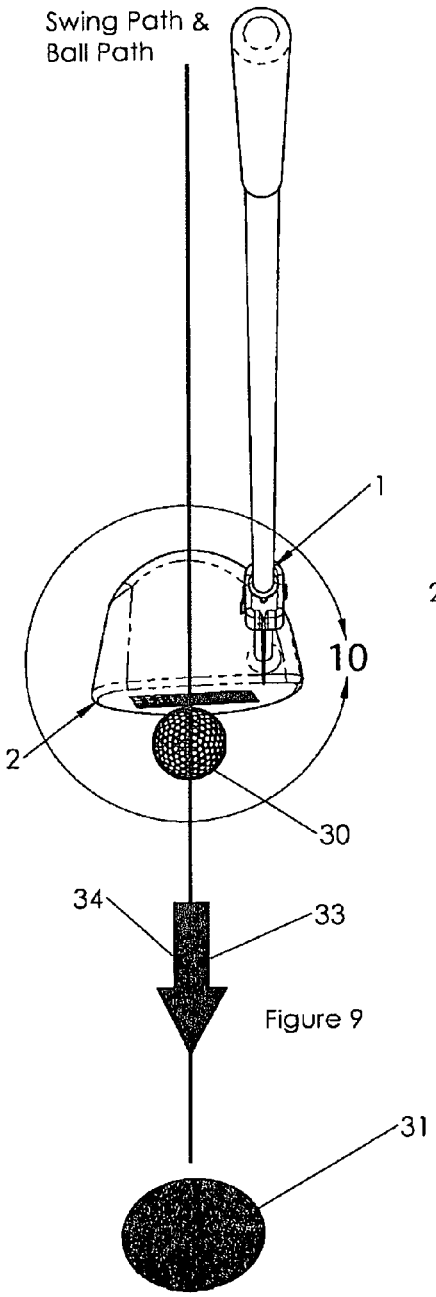
FIG. 9 is a view similar to FIGS. 5 and 7 depicting a condition of proper alignment of the golf club head to the direction of swing.
Figure 10:
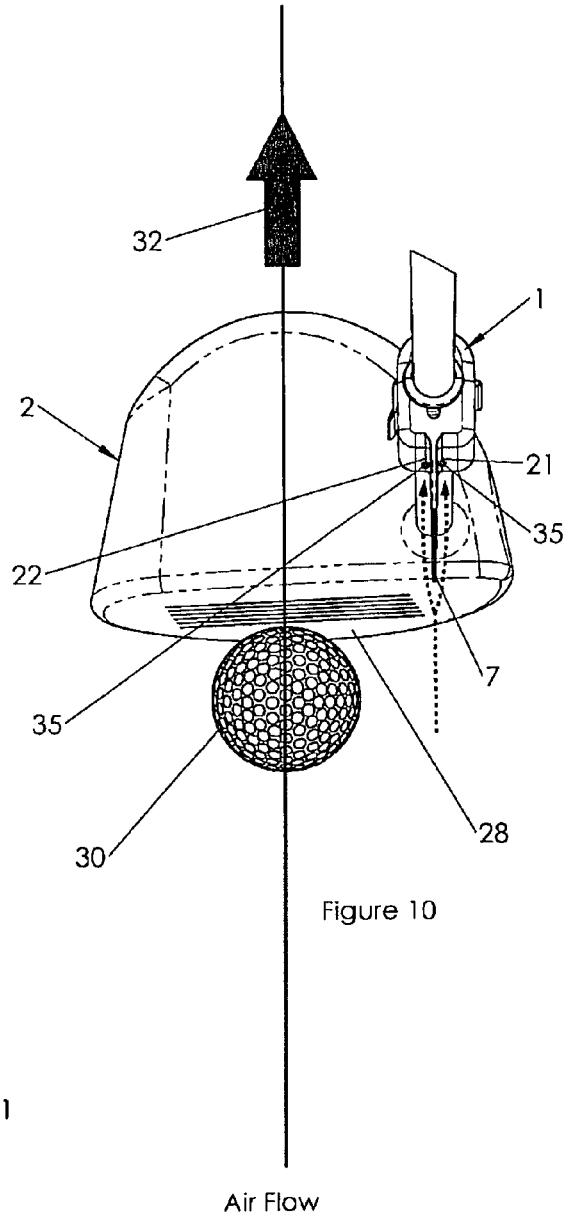
FIG. 10 is an enlargement of area A of FIG. 9.
Figure 11:
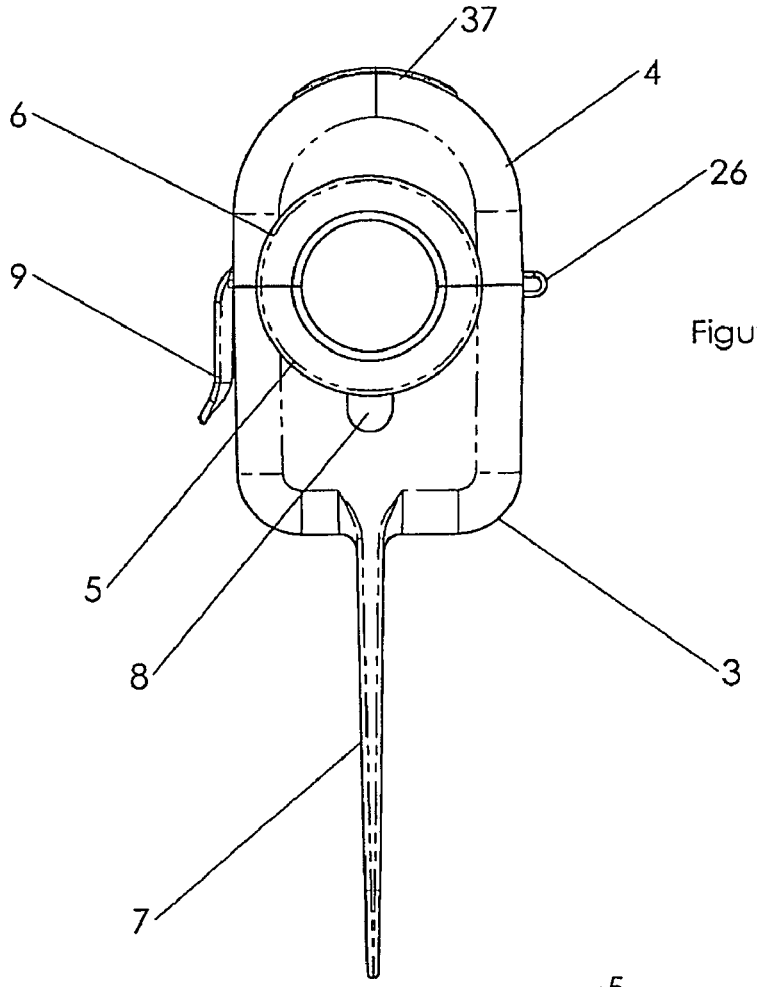
FIG. 11 is a top plan view of the invention.

Ref. FIGS. 9 and 10, the golf swing analyzer 1 is installed on club shaft 27 so as to align the fence 7 perpendicular with club face 28. During the golf swing, the ball 30 is driven toward hole 31 by a square impact of club face 28 on golf club 2. As the swing progresses, an induced air flow, as indicated by air flow direction 32, is split equally on each side of fence 7, creating equal high-pressure areas 35 presented on the front surface of analyzer housing 3.

Figure 12:
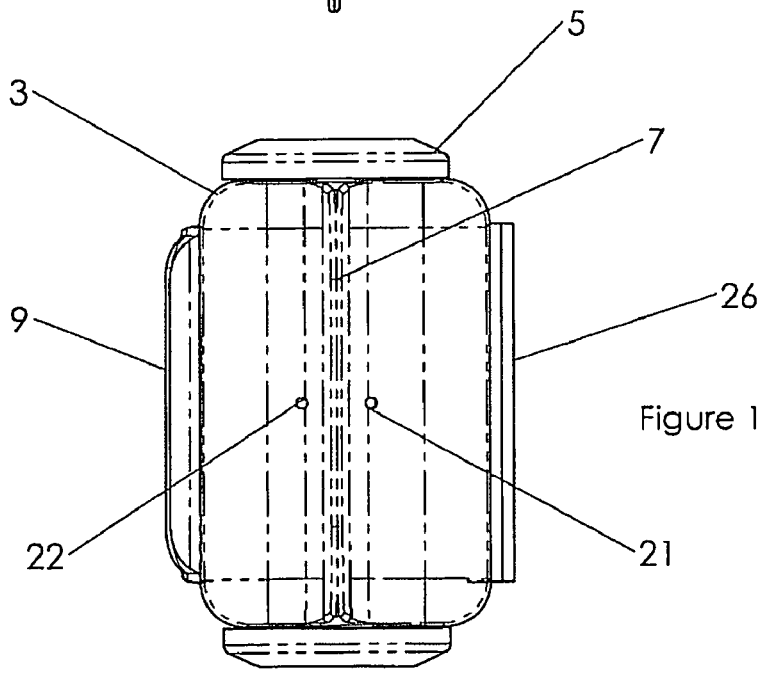
FIG. 12 is a front elevation view of FIG. 11.
Figures 16, 17:
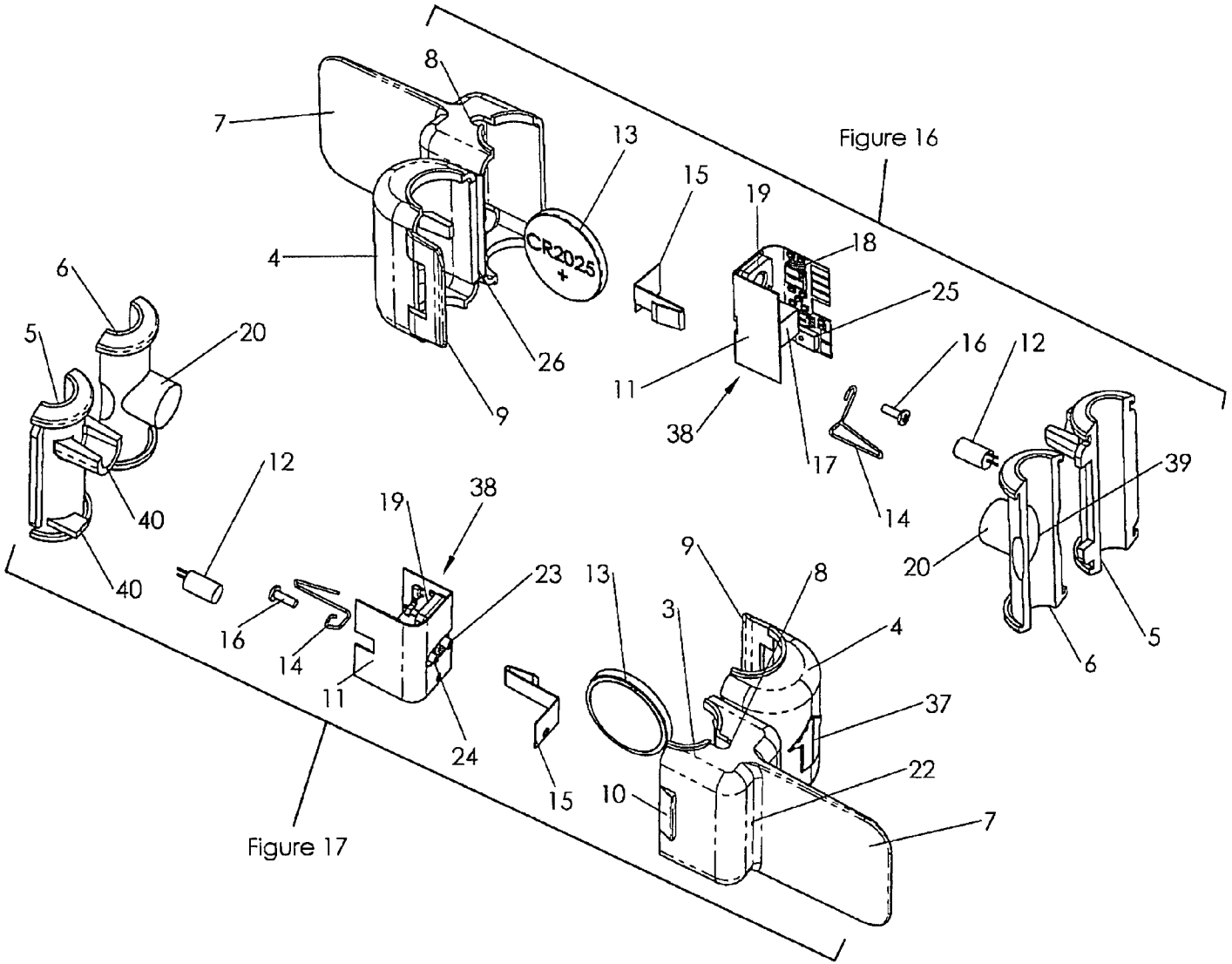
FIG. 16 is an exploded perspective view of FIG. 11.
FIG. 17 is another exploded perspective view of FIG. 11.

Ref. FIGS. 12, 16 and 19, left pressure aperture 21 on one side of fence 7 and right pressure aperture 22 on the opposite side of fence 7, located on the front wall of analyzer housing 3, translate this pressure through left pressure transducer inlet 23 and right pressure transducer inlet 24 on pressure transducer 17. Pressure transducer 17 is electrically connected to circuit board assembly 38. Circuit board assembly 38 also includes a microprocessor 18, microphone 25 and a speaker 19, interconnected by flexible circuit board 11. The block diagram of circuit board assembly 38 is shown on FIG. 20. The pressures presented to left pressure aperture 21 and right pressure aperture 22 are evaluated by microprocessor 18. If the club face 28 is square with the swing path direction 33 as in FIGS. 9 and 10, the high-pressure areas 35 will be equal and at the moment of impact with golf ball 30, the microprocessor 18 will output a unique signal to speaker 19. The audio tone from speaker 19 will travel through speaker aperture 8 to alert the golfer of the square impact of golf ball 30. The microprocessor 18 calculates these pressure readings at the exact moment of the ball impact by means of microphone 25 receiving the audio report of the impact. The golf ball 30 will follow ball path direction 34 in FIG. 9 and hopefully drop into hole 31.

Figure 5:
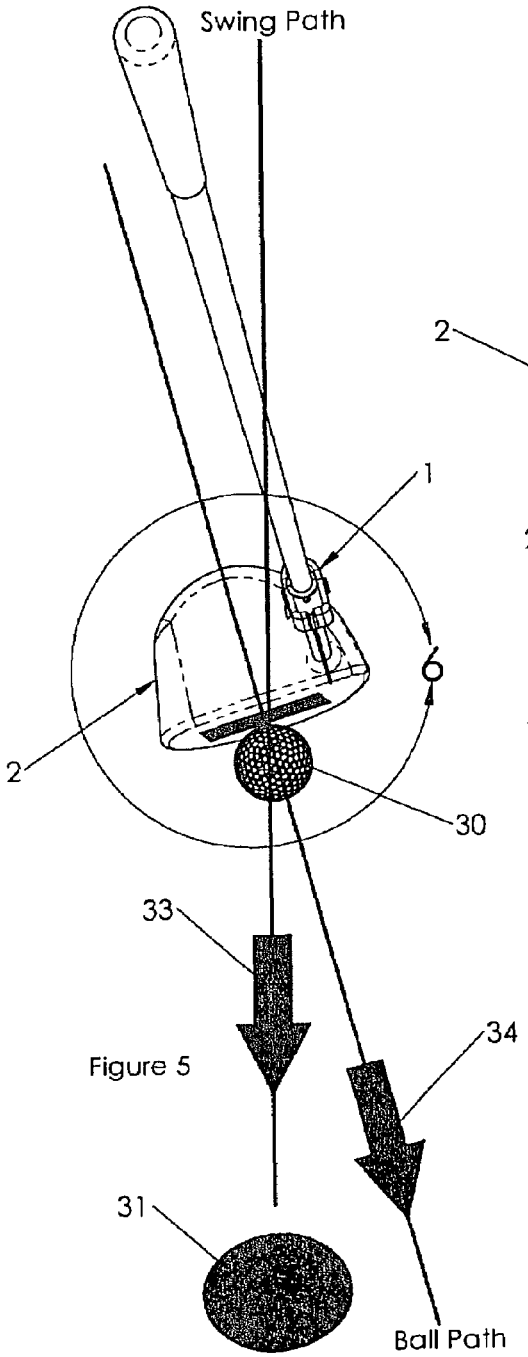
FIG. 5 is a top plan view of FIG. 1 depicting one condition of misalignment of the golf club head to the direction of swing.
Figure 6:
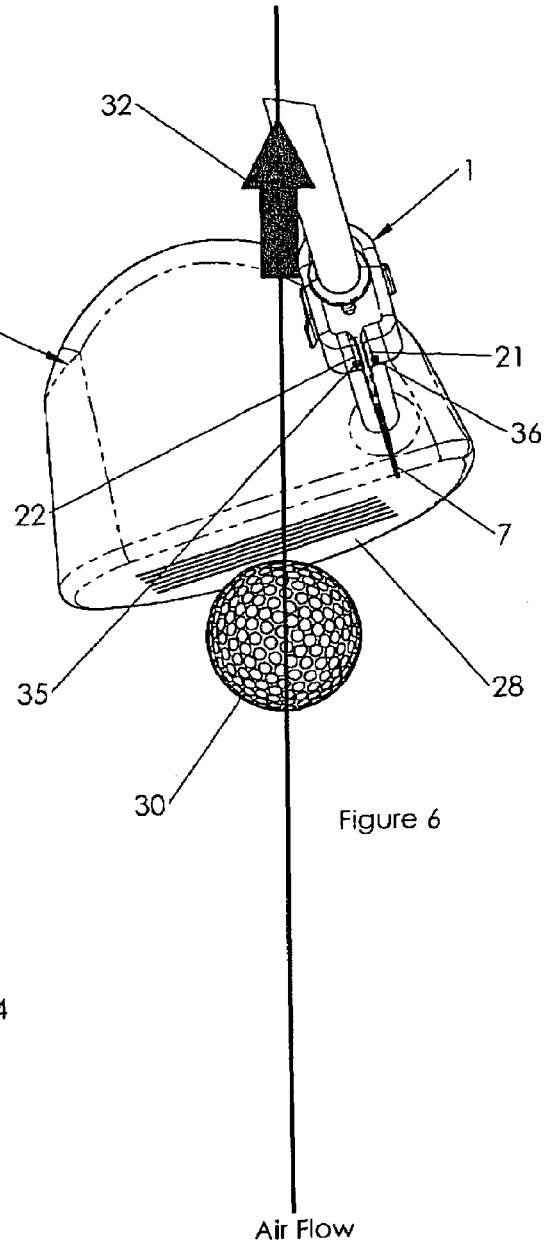
FIG. 6 is an enlargement of area 6 of FIG. 5.
Figure 20:
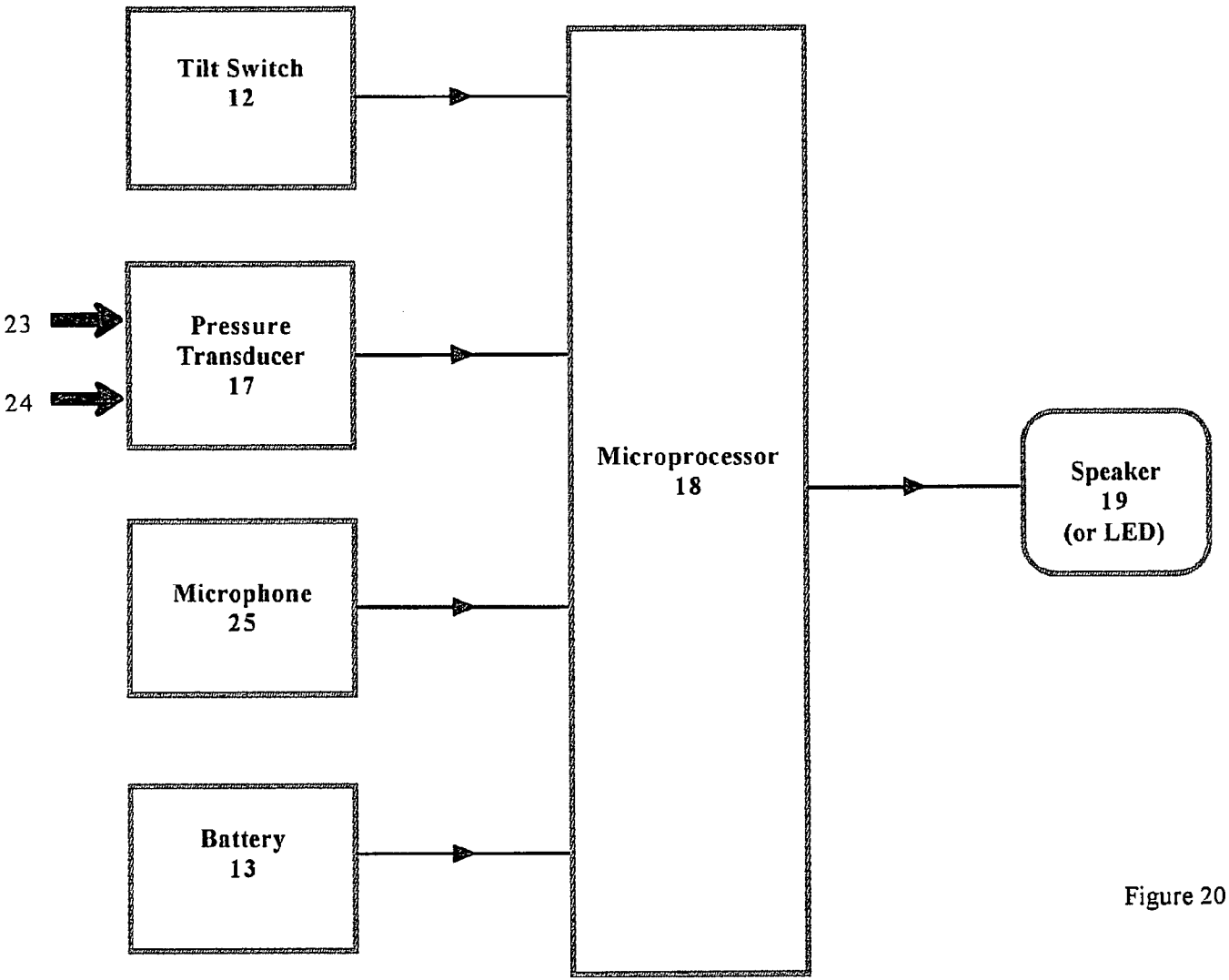
FIG. 20 is a simplified block diagram of the electrical control system of the invention.

Ref. FIGS. 5, 6 and 20, at the moment of impact with golf ball 30 as indicated by microphone 25, if the club face 28 on golf club 2 is closed or is in a non-square condition relative to swing path direction 33, the ball path direction 34 will cause golf ball 30 to miss the hole 31 or the intended direction of flight. The fence 7 on golf swing analyzer 1 will be in a non-parallel line with air flow direction 32 causing compression the air along fence 7 creating high pressure area 35 at right pressure aperture 22 and an air damming effect on the opposite side of fence 7 will present a low-pressure area 36 at left pressure aperture 21. The pressures presented to left pressure aperture 21 and right pressure aperture 22 is evaluated by microprocessor 18. The microprocessor 18 will output a unique signal to speaker 19. The audio tone from speaker 19 will travel through speaker aperture 8 to alert the golfer to the non-square or closed impact of golf ball 30.

Figure 7:
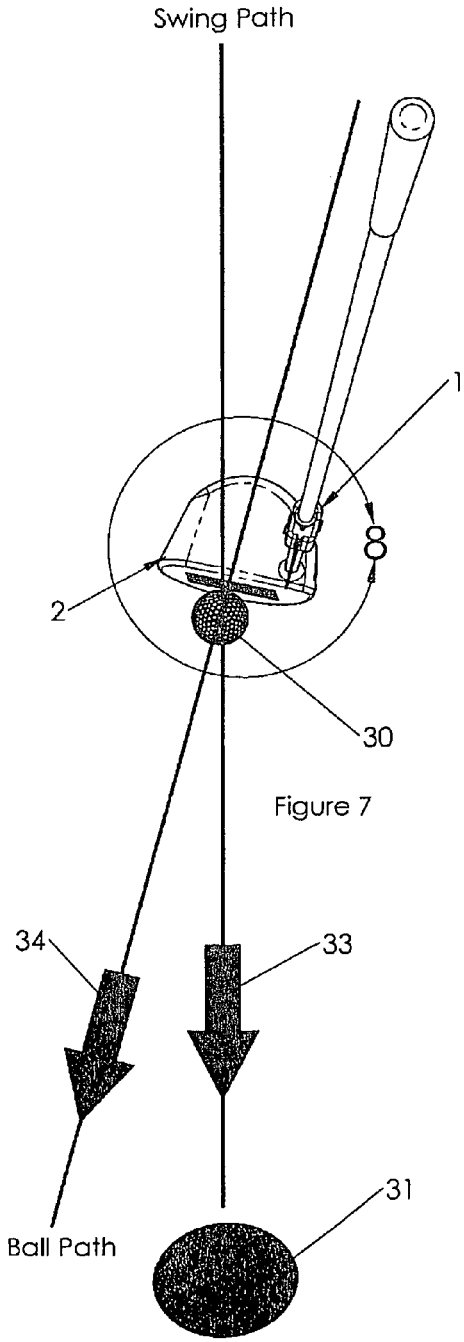
FIG. 7 is a top plan view of FIG. 3 depicting another condition of misalignment of the club head to the direction of swing.
Figure 8:
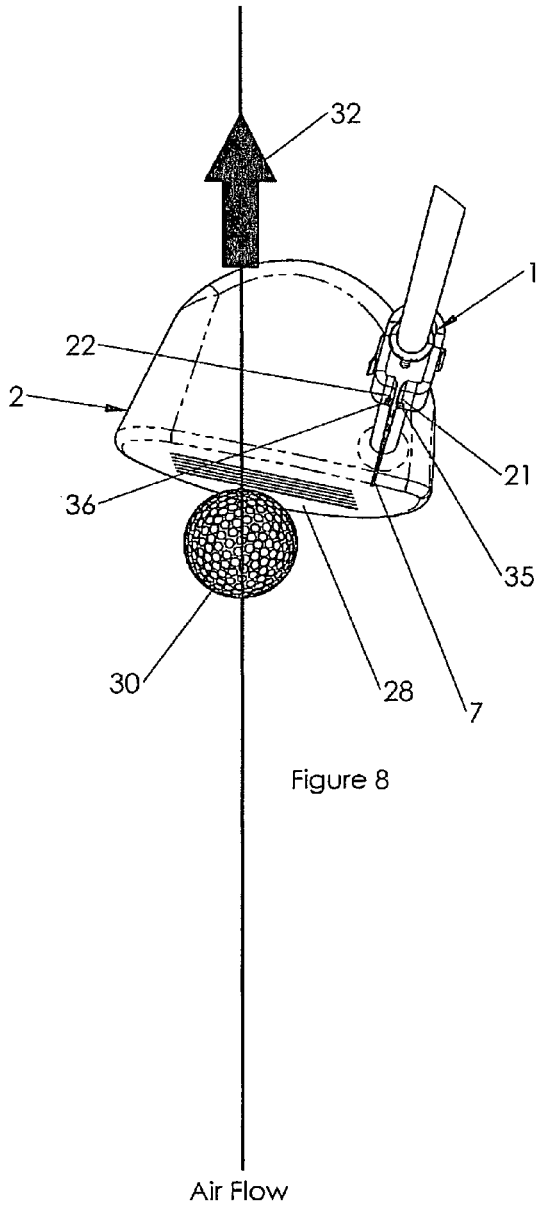
FIG. 8 is an enlargement of area 8 of FIG. 7.

Ref. FIGS. 7, 8 and 20, at the moment of impact with golf ball 30, as indicated by microphone 25, if the club face 28 on golf club 2 is open or in a non-square condition relative to swing path direction 33, the ball path direction 34 will cause golf ball 30 to miss the hole 31. The fence 7 on golf swing analyzer 1 will be in a non-parallel line with air flow direction 32 causing compression the air along fence 7, creating high-pressure area 35 at left pressure aperture 21 and an air damming effect on the opposite side of fence 7 will present a low-pressure area 36 at right pressure aperture 22. The pressures presented to left pressure aperture 21 and right pressure aperture 22 are evaluated by microprocessor 18. The microprocessor 18 will output a unique signal to speaker 19. The audio tone from speaker 19 will travel through speaker aperture 8 to alert the golfer of the non-square or open impact of golf ball 30.

Figure 13:
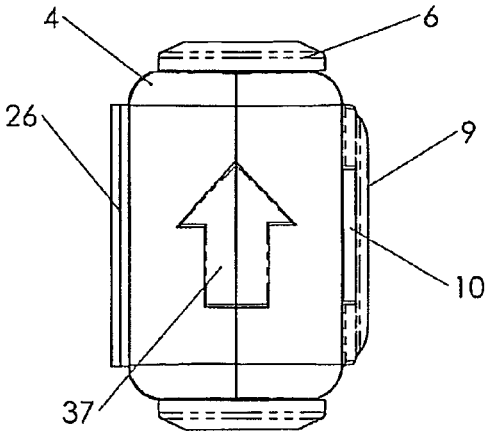
FIG. 13 is a rear elevation view of FIG. 11.
Figure 14:
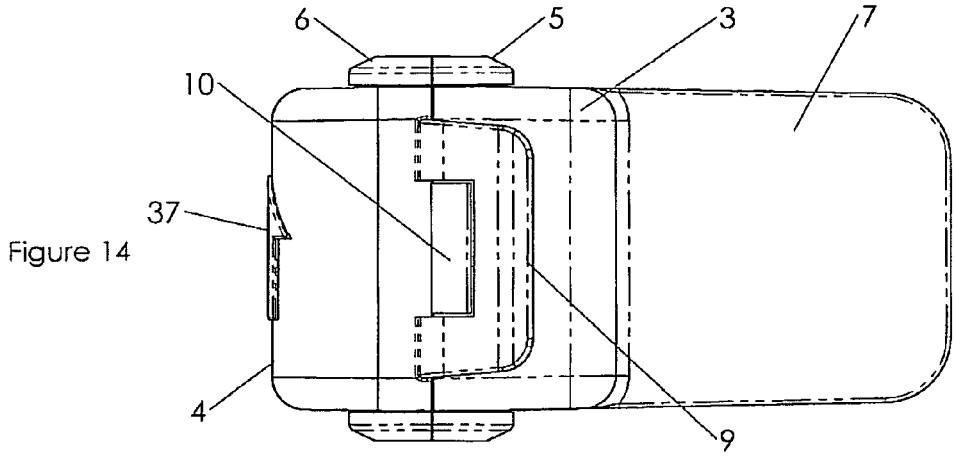
FIG. 14 is a right side elevation view of FIG. 11.
Figure 15:
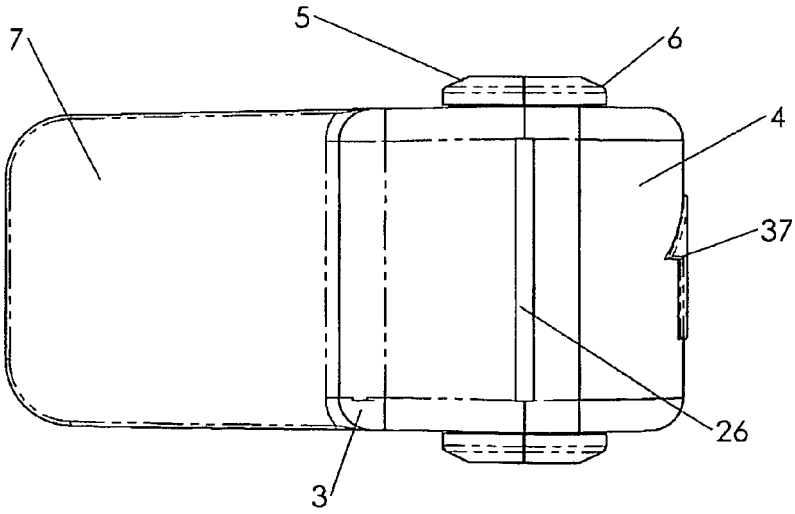
FIG. 15 is a left side elevation view of FIG. 11.

Ref. FIG. 13, a position arrow 37 is molded on housing retainer 4 to show the proper orientation of the golf swing analyzer 1 when installed on golf club 2. This allows the unique tones of the device 1 to agree with the instruction manual for a right-handed or left-handed golfer. For a right-handed golfer the arrow 37 points up. For a left-handed golfer the arrow 37 points down.

Ref. FIGS. 16, 17, 18, 19 and 20, the circuit board assembly 38 is powered by a CR2025 3 volt battery 13. This battery 13 is retained in position by battery retainer boss 29 when the golf swing analyzer 1 is snapped closed around club shaft 27 by means of latch 9 and latch retainer 10. Contact is made to the battery by means of positive contact 14 and negative contact 15. These contacts 14 and 15 are electrically connected to flexible circuit board 11 by means of contact retaining screw 16. The flexible circuit board 11 is held in place and mechanically shock mounted by circuit retainer boss 40 located on rear grip 6. This shock mount is created by the elastic nature of the elastomer from which retainer boss 40 is constructed. After 3 minutes of non-use, the microprocessor 18 puts the electronic circuits to sleep to preserve battery power. This sleep mode is cancelled to allow the device to work by tilt switch 12. This tilt switch 12 is activated by movement of a small-gold plated ball hitting contacts internal to this tilt switch 12.

Note that, although the preferred embodiment described above depends upon distinct audible signal indicia to advise the golfer of the accuracy nature of each swing, viewable indicia such as by LEDs are considered an alternate substitute.

While a number of exemplary aspects and embodiments have been discussed above, those of skill in the art will recognize certain modifications, permeations and additions and subcombinations thereof. It is therefore intended that the following appended claims and claims hereinafter introduced are interpreted to include all such modifications, permeations, additions and subcombinations that are within their true spirit and scope.

The invention claimed is:

1. A golf club impact analyzer for a golf club having a shaft with a grip and a head with a striking face, said impact analyzer comprising:

a housing having a forwardly extending elongated generally planar fence defining a longitudinal intended line of flight, said housing being attachable to the golf club shaft just above the head of the golf club, said fence providing a visual alignment which, when aligned perpendicular to the striking face, corresponds to the intended line of flight;

said fence rigidly connected to said housing generally parallel to the longitudinal axis of the golf club shaft when said housing is attached to the shaft;

right and left air pressure sensors connected to said housing on the right and left, respectively, side of, and forwardly facing in the same direction as, said fence, each of said air pressure sensors producing a signal proportionally responsive to movement of air flowing therepast during each swing of the golf club;

an electronic circuit within said housing receiving the signals from each of said air pressure sensors producing a sensorially perceivable signal relative to alignment or misalignment between said stationary member and the direction of golf club head swing at the moment of impact of the golf club head with a golf ball.

2. A golf club swinging guide for a golf club having a shaft with a grip and a head with a striking face, said guide comprising:

a housing having a forwardly extending elongated stationary generally planar fence, said fence being rigidly formed as a unit with said housing, said housing being attachable to the golf club shaft just above the head of the golf club;

said fence generally lying in a plane passing through the shaft and further providing a visual alignment which, when properly installed and aligned on the shaft, is oriented perpendicular to the striking face;

an electronic circuit held within said housing producing a sensorially perceivable output relative to alignment or misalignment between said fence and the direction of golf club swing at the moment of impact of the golf club head with a golf ball;

said circuit receiving an electrical signal from right and left closely spaced air pressure sensors, said right sensor being positioned in close proximity to a right side of said fence, said left sensor being positioned in close proximity to a left side of said fence, said sensors causing said circuit to activate a light or sound emitter in said housing which produces said output.

* * * * *